US005301833A

United States Patent [19]

Aycan

[11] Patent Number: 5,301,833

[45] Date of Patent: Apr. 12, 1994

[54] LIQUID DISPENSER WITH CUP HOLDER

[76] Inventor: Erkin Aycan, 7 Ennismore Place, Willowdale, Ontario M2J 1Z9, Canada

[21] Appl. No.: 10,785

[22] Filed: Jan. 29, 1993

Related U.S. Application Data

[63] Continuation-in-part of Ser. No. 992,783, Dec. 18, 1992, abandoned.

[51] Int. Cl.[5] ..... A47F 1/08

[52] U.S. Cl. ..... 221/96; 206/217; 215/6; 221/63; 221/199; 221/307

[58] Field of Search ..... 222/130, 192; 221/96, 221/45, 63, 302-310, 197, 199, 287; 206/217; 229/213; 215/6, 10, 12.1

[56] References Cited

U.S. PATENT DOCUMENTS

| | | | |
|---|---|---|---|
| 2,218,670 | 10/1940 | Bennett | 229/213 X |
| 2,323,841 | 7/1943 | Pape et al. | 221/310 X |
| 2,374,092 | 4/1945 | Glaser | 215/6 |
| 2,978,132 | 4/1961 | Huck | 206/217 X |
| 3,262,596 | 7/1966 | Zillmann | 206/217 X |
| 3,469,739 | 9/1969 | Phillips | 222/553 X |
| 4,484,694 | 11/1984 | Reuteman et al. | 221/197 |
| 4,889,261 | 12/1989 | Conrad | 206/514 X |

*Primary Examiner*—Kevin P. Shaver

[57] ABSTRACT

A liquid dispenser for storing and dispensing liquids is disclosed. In one aspect the dispenser is a bottle such as that used for storing soft drinks, detergents and the like. The bottle is provided with a cup holder which includes an annular recess extending upwardly from the bottom of the bottle and which is dimensioned to receive therein several drinking cups. The cups, which may be drinking cups or measuring cups, are retained in the annular recess by spaced projections extending inwardly toward the longitudinal axis of the bottle. The projections are dimensioned so the cup lips are inwardly deformed as they pass over the projections. The bottles may be fabricated of plastic, paper or glass and the cups of plastic or paper.

14 Claims, 9 Drawing Sheets

LIQUID DISPENSER WITH CUP HOLDER

The present United States patent application is a continuation-in-part of United States patent application Ser. No. 992,783, filed on Dec. 18, 1992, now abandoned.

FIELD OF THE INVENTION

The present invention relates to a liquid dispenser provided with a cup holder.

BACKGROUND OF THE INVENTION

Liquid dispensing bottles for soft drinks, detergents and the like are well known. These bottles are generally made of plastic or glass and may be readily recycled. Soft drink bottles come in many sizes and the larger family sized bottles are particularly useful in applications such as family outings including picnics and camping trips. A drawback to this arrangement is that extra cups must be transported independently of the bottle so that several individuals may drink from the bottle.

Liquid detergent bottles do not normally carry a measuring cup per se. However, the bottle cap may be dimensioned specifically to serve the function of a liquid dispenser or alternatively, measuring cups may be attached by being placed over the bottle cap and sealed thereto using shrink wrap placed around the cup and bottle. A drawback to this arrangement is that the packing volume, which is the volume of space occupied by the combination cup/bottle, is increased. Solid detergent boxes sometimes contain a measuring cup enclosed within the box. It would not be practical or even possible to enclose cups in soft drink bottles and the like.

Accordingly, it is advantageous to provide a liquid dispenser for soft drinks, beer, juices and other liquid foodstuffs and detergents which incorporates directly into the structure of the liquid dispenser a cup holder which does not increase the packing volume of the container and which does not result in an unsightly product.

SUMMARY OF THE INVENTION

The subject invention provides a liquid dispenser such as a bottle which is provided with a recessed or hollow portion which may be used for storing therein novelty and promotional items such as compact discs, small toys, and money and the like. Alternatively, the storage location may be used for storing more functional items such as cups.

In one aspect, the subject invention provides a liquid dispenser of the type having a container portion enclosing a liquid storage compartment. The dispenser includes at least one outlet passageway in flow communication with the liquid storage compartment through which liquid may be dispensed from the liquid storage compartment. The improvement in the liquid dispenser comprises the container being provided with a recessed portion not in communication with the liquid storage compartment for receiving and storing therein objects. The liquid dispenser includes retaining means for retaining the objects in the recessed portion.

In another aspect of the invention a liquid dispenser is provided which comprises a container enclosing a liquid storage compartment and having an outlet passageway in flow communication with the liquid storage compartment through which liquid may be dispensed from the liquid storage compartment. The container is provided with a recessed portion spaced from the outlet passageway and not in communication with the liquid storage compartment for receiving therein at least one cup means. The liquid dispenser is provided with retaining means for retaining the at least one cup means in the recessed portion.

In another aspect of the invention there is provided a liquid dispenser comprising a storage portion enclosing a liquid storage compartment and having an outlet passageway at one end thereof in flow communication with the liquid storage compartment through which liquid may be dispensed from the liquid storage compartment. Included is a base portion which is substantially hollow, the base portion being attached to the other end of the storage portion. The hollow portion of the base forms a storage area for receiving therein objects to be stored. The liquid dispenser is provided with retaining means for retaining said objects in said storage area.

BRIEF DESCRIPTION OF THE DRAWINGS

The combination liquid dispenser and cup holder forming the subject invention will now be described, reference being had to the accompanying drawings, in which.

DETAILED DESCRIPTION OF THE INVENTION

Figure 1:
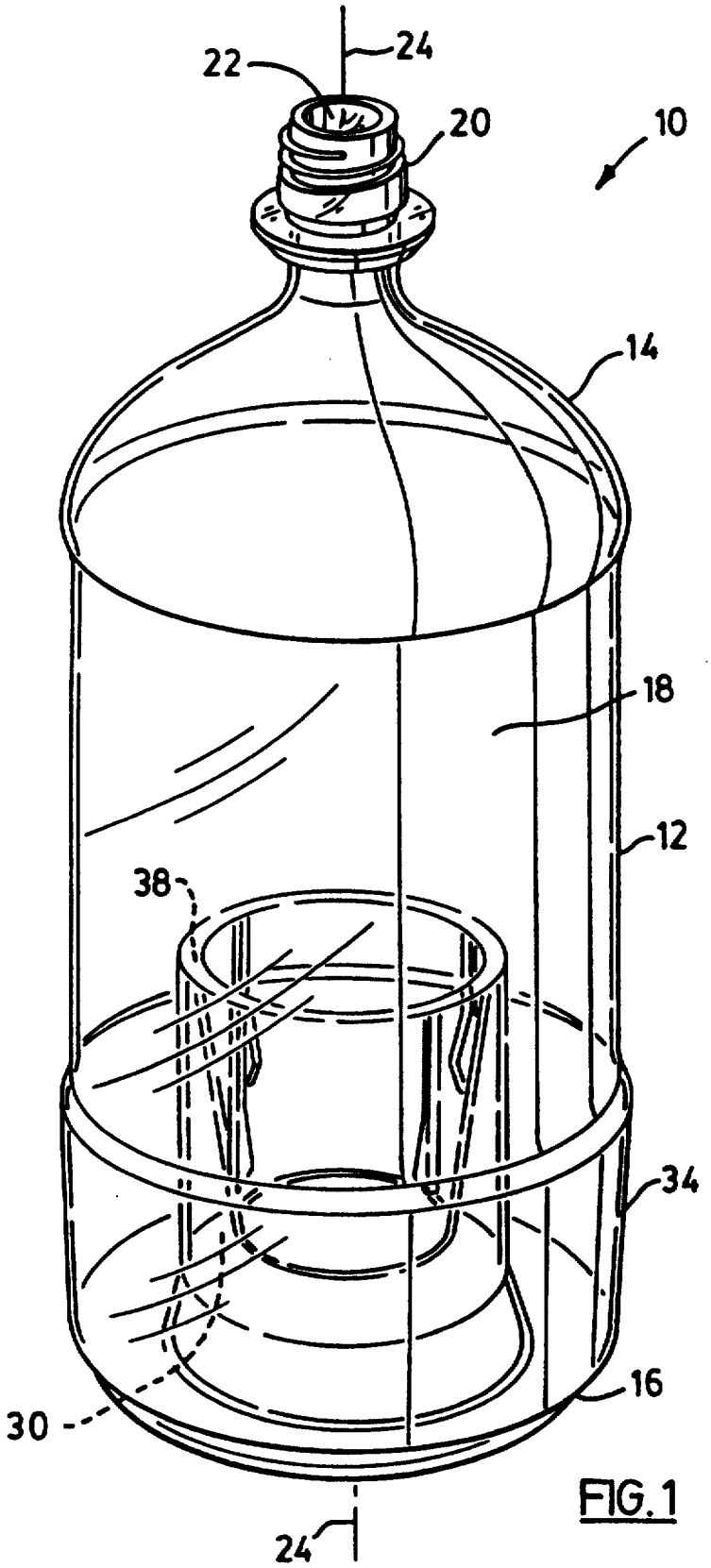
FIG. 1 is a perspective view of a bottle made in accordance with the present invention.
Figure 2:
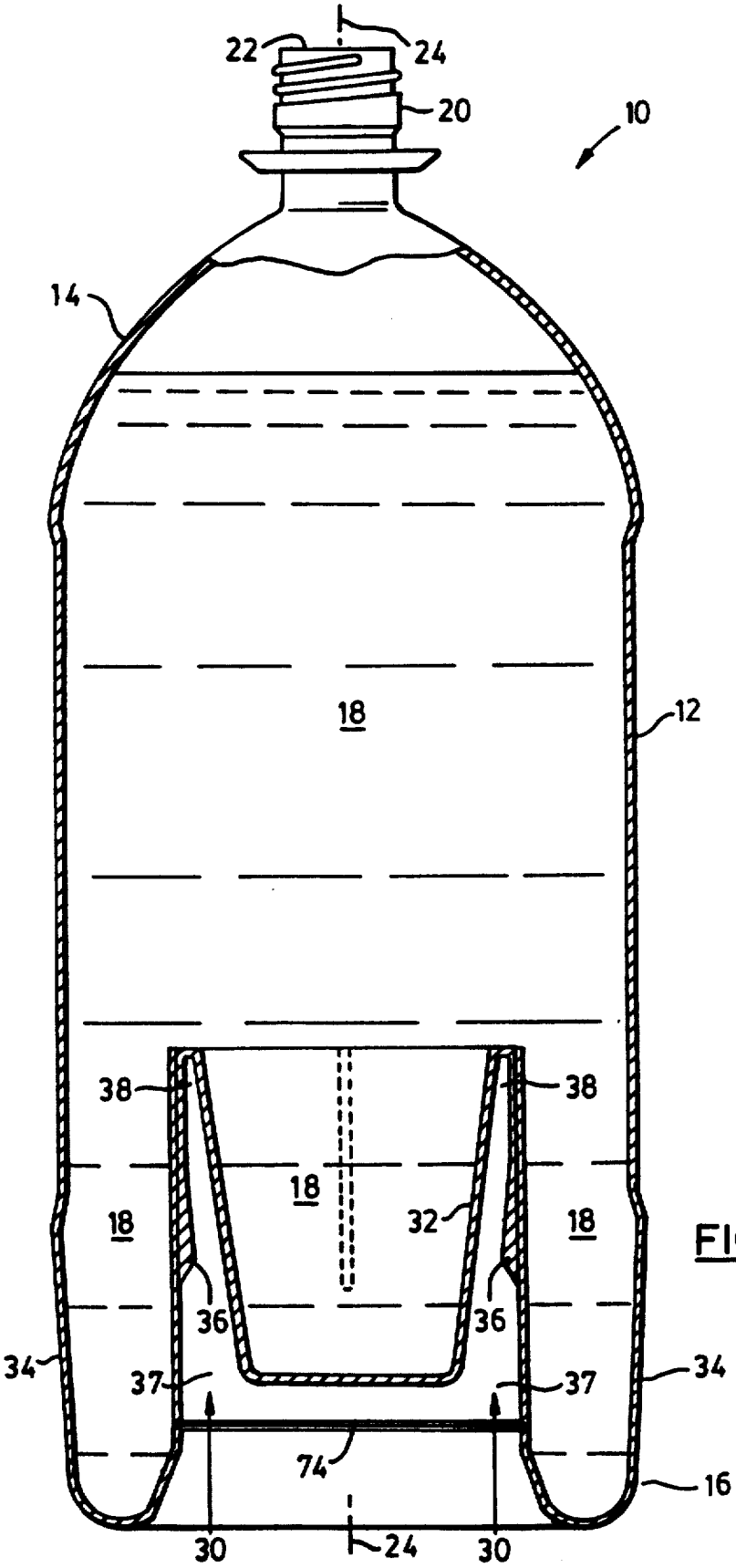
FIG. 2 is a sectional elevational view of the bottle of FIG. 1.

In the ensuing description of the structure and operation of the liquid dispenser forming the present invention, reference will be made to the drawings in which like numerals refer to like parts. Referring first to FIGS. 1 and 2, a liquid dispenser is shown generally at 10 and is in the form of a cylindrically shaped bottle comprising a shell or container 12 having two opposed end portions 14 and 16. Container 12 encloses a liquid storage compartment 18. Located at end portion 14 is a spout 20 enclosing an outlet passageway 22 in flow communication with liquid storage compartment 18 for dispensing liquid from bottle 10. Bottle 10 includes a lid or closure member (not shown) for sealing the bottle closed. Cylindrically shaped bottle 10 has a longitudinal axis 24 extending along the length thereof.

Bottle 10 includes an annular recess 30, best seen in FIG. 2, formed in end portion 16 of the bottle which extends from the bottom of the bottle towards the top thereof. Annular recess 30 is located between an inner downwardly projecting cup shaped portion 32 forming part of container 12 and an outer annular support portion 34 also part of container 12 which forms a support for supporting bottle 10 in the vertical position as shown in FIGS. 1 and 2. Cup shaped portion 32 and annular support portion 34 are both form part of liquid compartment 18. Attached to the inner surface of annular portion 34 are four inwardly projecting protrusions 36 equally spaced from each other. There could be more or less than four, as long as they served to adequately retain cups 40 in recess 30. Protrusions 36 are integrally formed with the rest of container 12 and may take on any number of shapes.

Bottle 10 may be fabricated of a suitable plastic material or glass in the normal method as usually used in the fabrication of soft drink or liquid detergent bottles.

Figure 3:
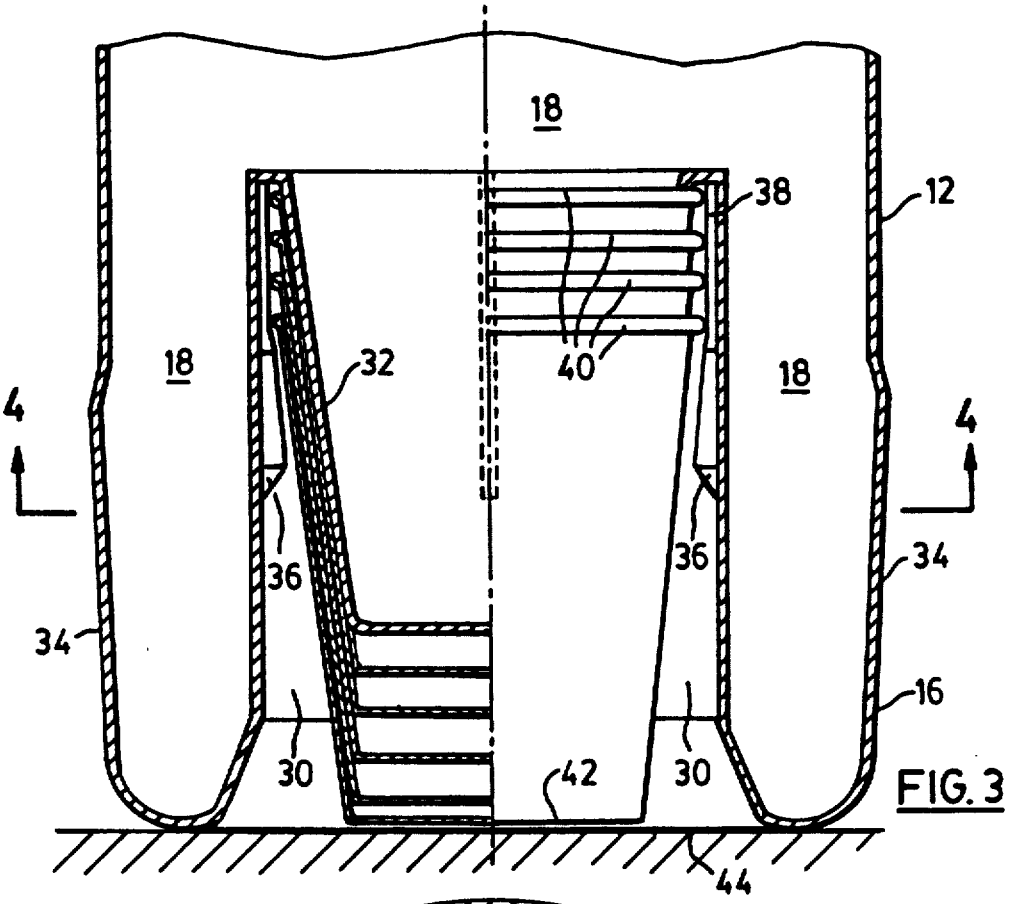
FIG. 3 is a partial sectional view, broken away, of the lower part of the bottle of FIG. 2 showing cups stored in the dispenser portion thereof.
Figure 4:
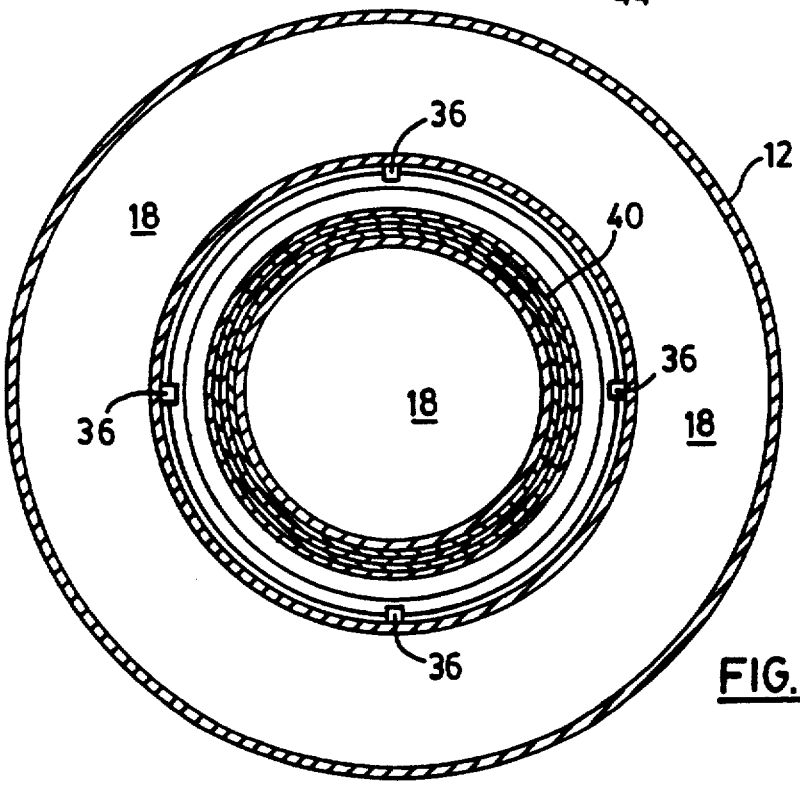
FIG. 4 is a sectional view along the line 4—4 of FIG. 3.

Referring to FIG. 3, annular recess 30 functions as a cup holder for receiving and holding therein cups 40. Cups 40 may be drinking cups or measuring cups depending on the function of the liquid retained in the liquid dispenser. Recess 30 is tapered from a wide end 37 adjacent the bottom of bottle 10 to a narrower end 38. In this way the volume of storage compartment 18 lost due to the presence of recess 30 is kept to a minimum. A standard 2 liter sized bottle fabricated with annular recess 30 of the present invention may therefore be filled with a standard 1.5 liter volume of liquid. Alternatively, a standard 1.5 liter bottle comprising annular recess 30 may be fabricated of greater length or diameter or both to compensate for the volume lost due to the inclusion of recess 30.

Cups 40 are retained in annular recess 30 by projections 36. Specifically, as cups 40 are inserted into annular recess 30, they deform as they are pushed past projections 36 since the diameter of cups 40 at the lips thereof is greater than the distance between two opposed projections 36. The depth of annular recess 30 is preferably chosen so that when the cups are packed into the recess, the bottom 42 of the last cup in is located above the supporting surface 44 supporting bottle 10. In this way a plurality of cups may be stored in the bottom of the bottle. Bottle 10 may be fabricated of recyclable plastic, liquid impermeable paper or glass and the cups may be fabricated of recyclable plastic or paper. Thus, once the contents of the bottle have been consumed, the empty cups may be reinserted into the bottle holder and the combination discarded or recycled as desired.

Cups 40 may be secured within recess 30 after the bottles are filled and sealed at the factory by enveloping the whole bottle or alternatively just the bottom part thereof with a known wrapper such as heat shrink plastic used in packaging.

Figure 5:
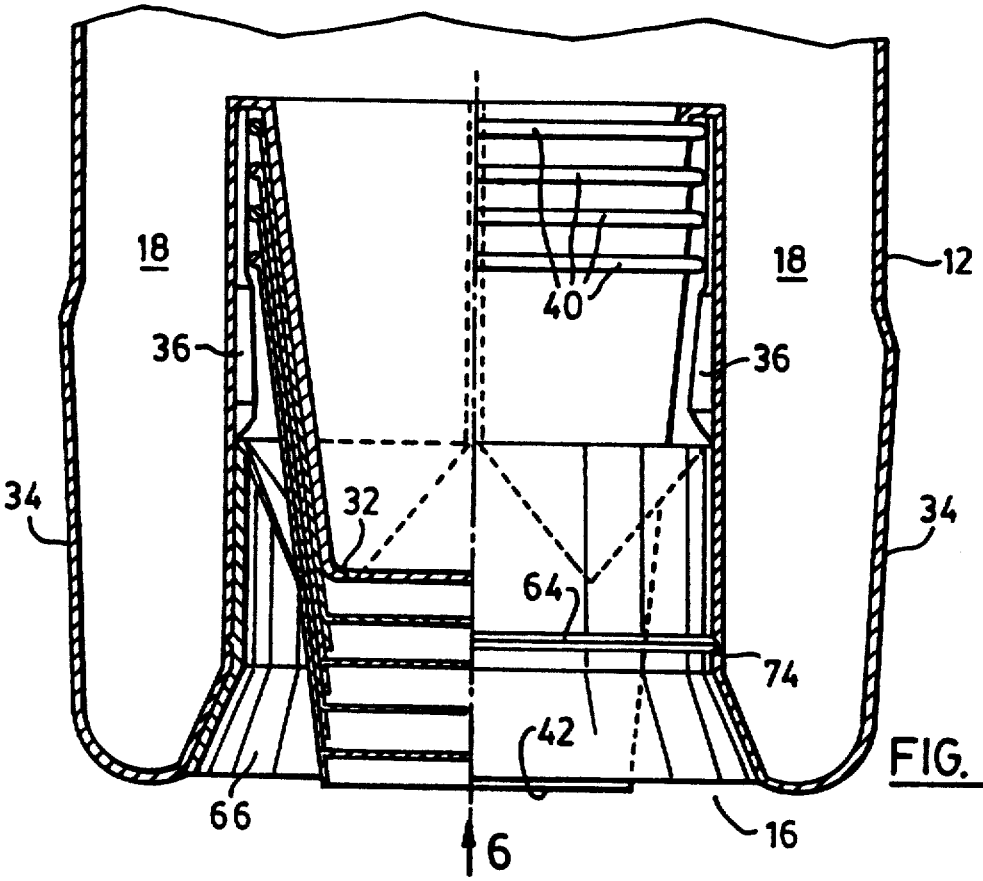
FIG. 5 is a view similar to FIG. 3 but of another embodiment of the invention.
Figure 6:
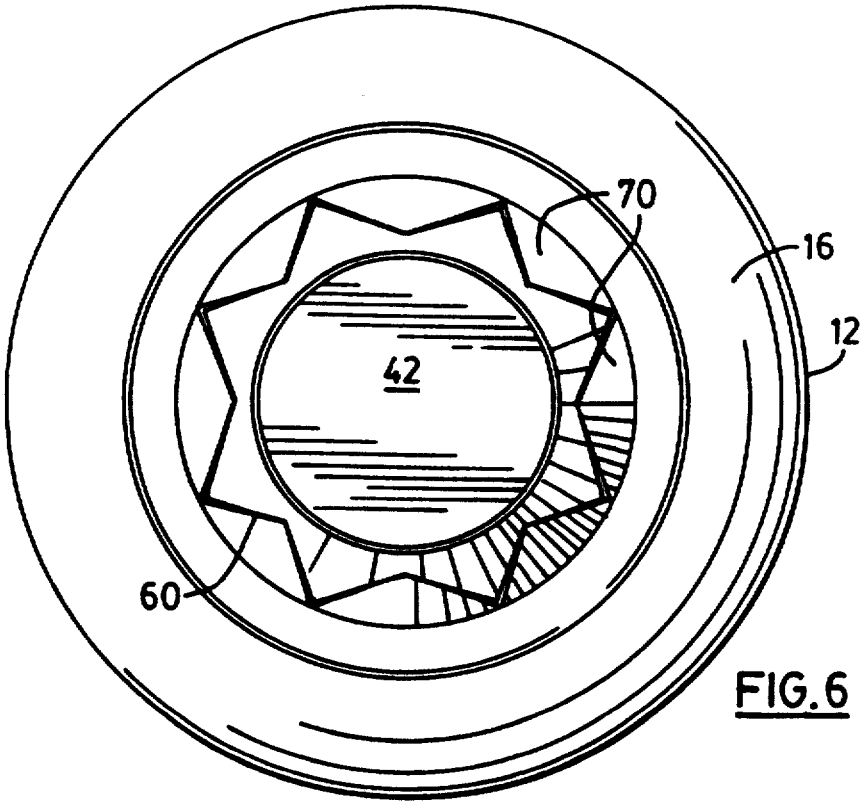
FIG. 6 is a view along arrow 6 of FIG. 5.
Figure 7:
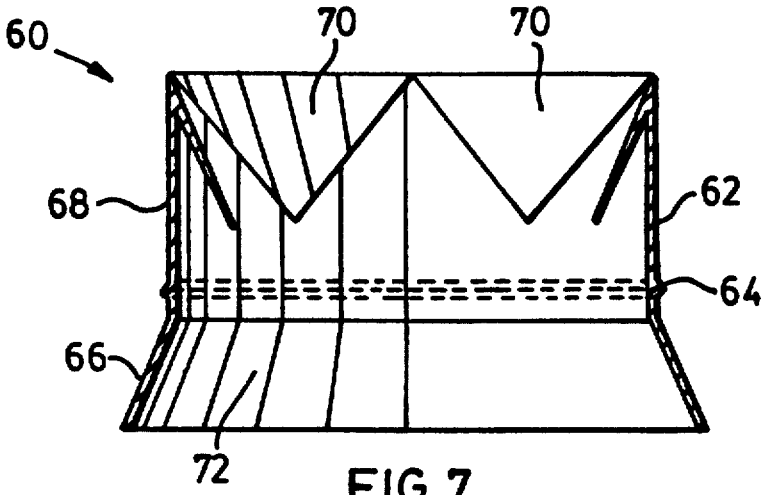
FIG. 7 is an elevational view of a cup retainer forming part of another embodiment of the present invention.

In another embodiment of the invention a cup guard may be used to protect cups 40 in recess 30 from dirt entering recess 30. Referring specifically to FIGS. 5–7, a cup guard 60 comprises a generally cylindrical plastic body 62 having a circumferentially disposed outwardly projecting rib 64. A funnel shaped skirt 66 extends downwardly and outwardly from rib 64. Extending upwardly from rib 64 is an outwardly flared crown shaped portion 68 comprising a plurality of triangular shaped flanges 70, best seen in FIG. 7, which act as dirt guards. Cup guard 60 includes a passageway 72 which is dimensioned so that cups 40 may be pulled therethrough. Referring to FIG. 5, annular support portion 34 is provided with a circumferential groove 74 on the inner surface thereof. Once cups 40 have been received into recess 30, guard 60 is inserted into the recess until rib 64 is received into groove 74. Flanges 70 bear against the inner surface of support 34 below projections 36. Cups 40 have a maximum diameter at the lip of the cups which is slightly larger than the diameter of hole 72 so that the cups flex as they are pulled through the hole.

Figure 8:
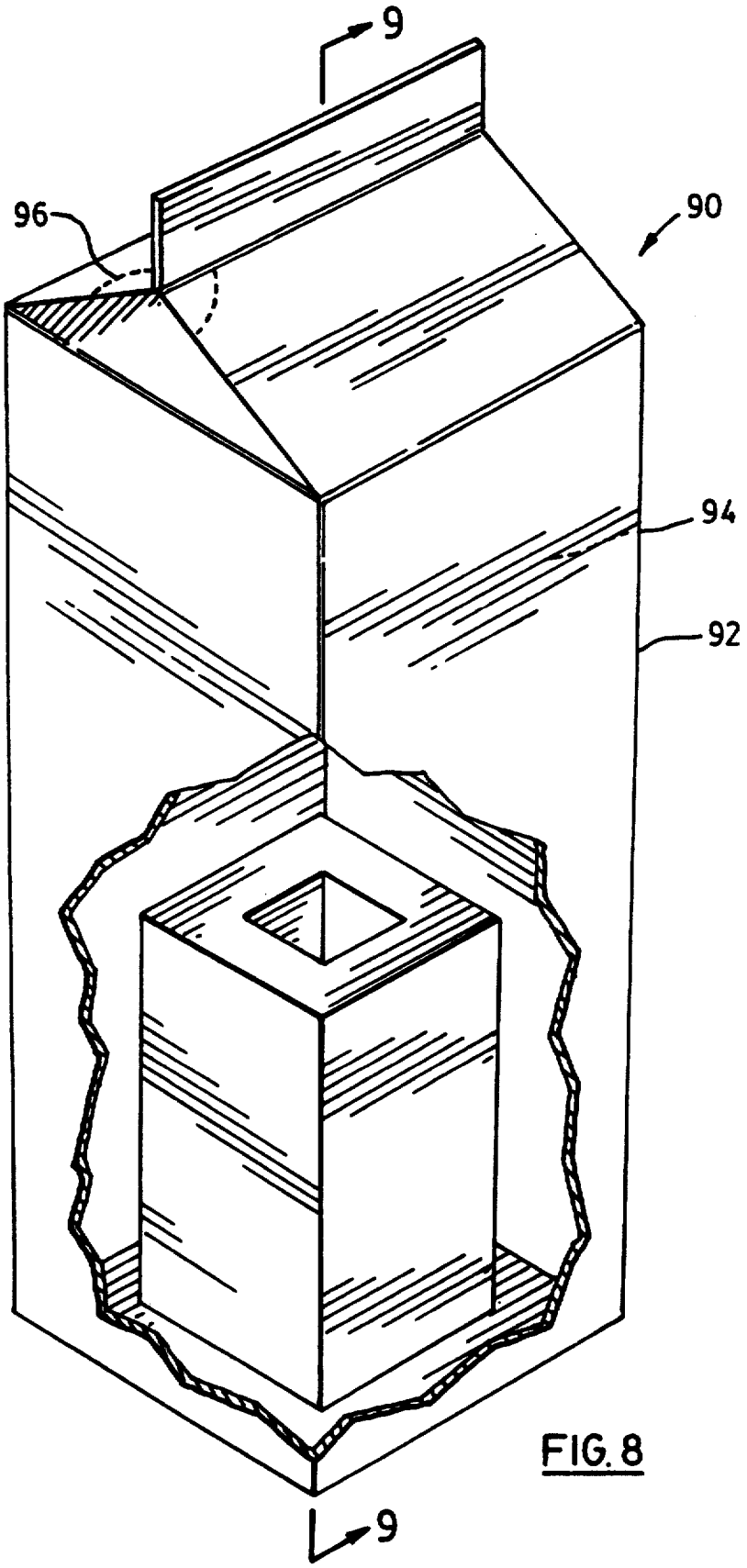
FIG. 8 is a perspective view of an alternative embodiment of a liquid dispenser constructed in accordance with the present invention.
Figure 9:
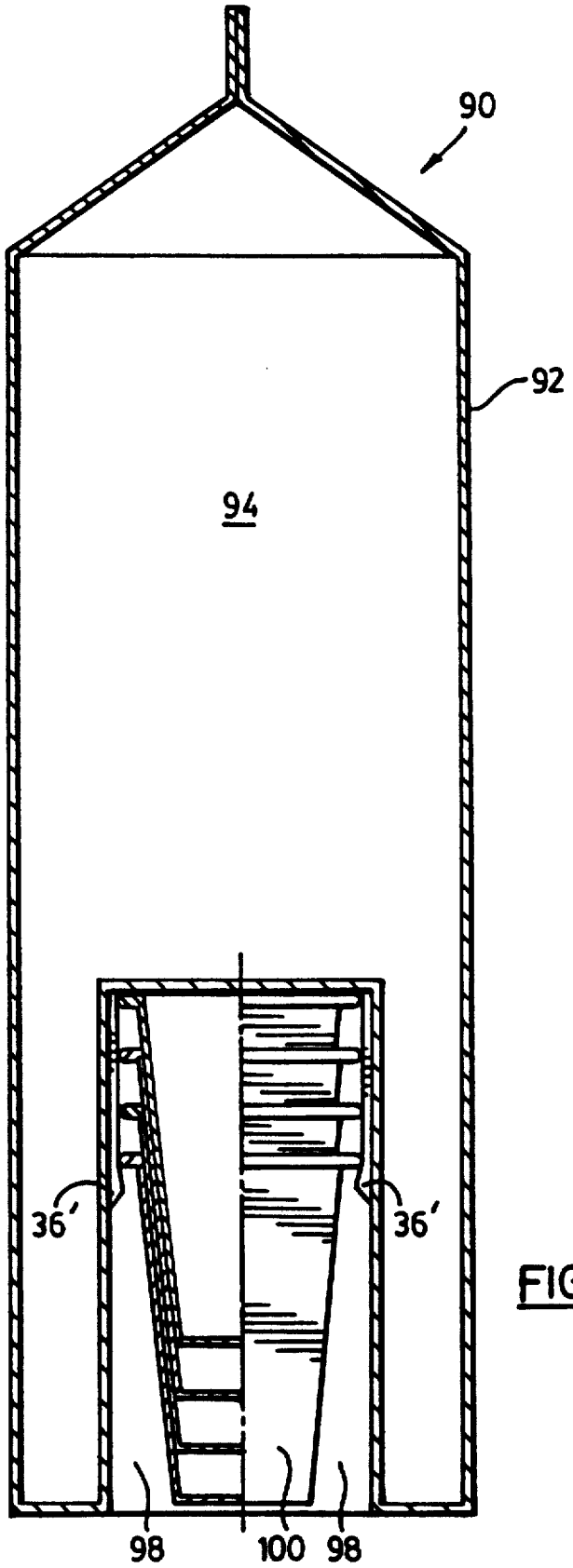
FIG. 9 is a vertical sectional view along the line 9—9 of FIG. 8.

Another embodiment 90 of a combination liquid dispenser and cup holder is shown in FIGS. 8 and 9. Dispenser 90 comprises a rectangular carton 92 fabricated of a suitable liquid impermeable paperboard material and having a liquid storage portion 94 and a spout 96 formed by the folded cardboard side portions located at the top of the carton. A rectangular recess 98 extends inwardly toward storage portion 94 from the bottom of carton 92. Recess 98 is dimensioned to receive therein a plurality of rectangular cups 100. Those skilled in the art will appreciate how carton 92 may be fabricated using standard fabrication procedures, for example being assembled from an appropriately die cut cardboard blank. Carton 92 may be used for holding various liquids such as juices, milk and the like.

Figure 10:
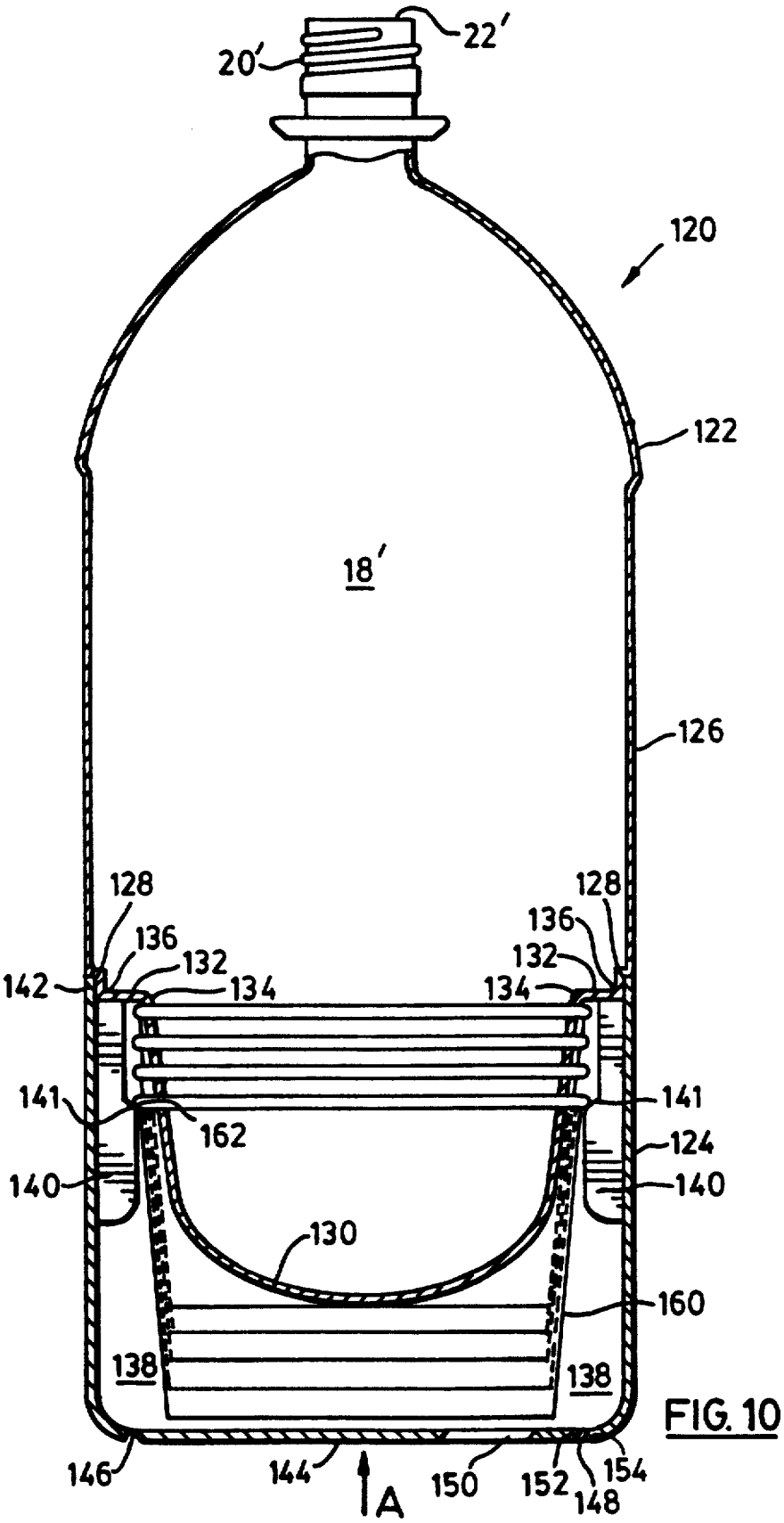
FIG. 10 is a sectional elevational view of another embodiment of the liquid dispenser constructed in accordance with the present invention.
Figure 11:
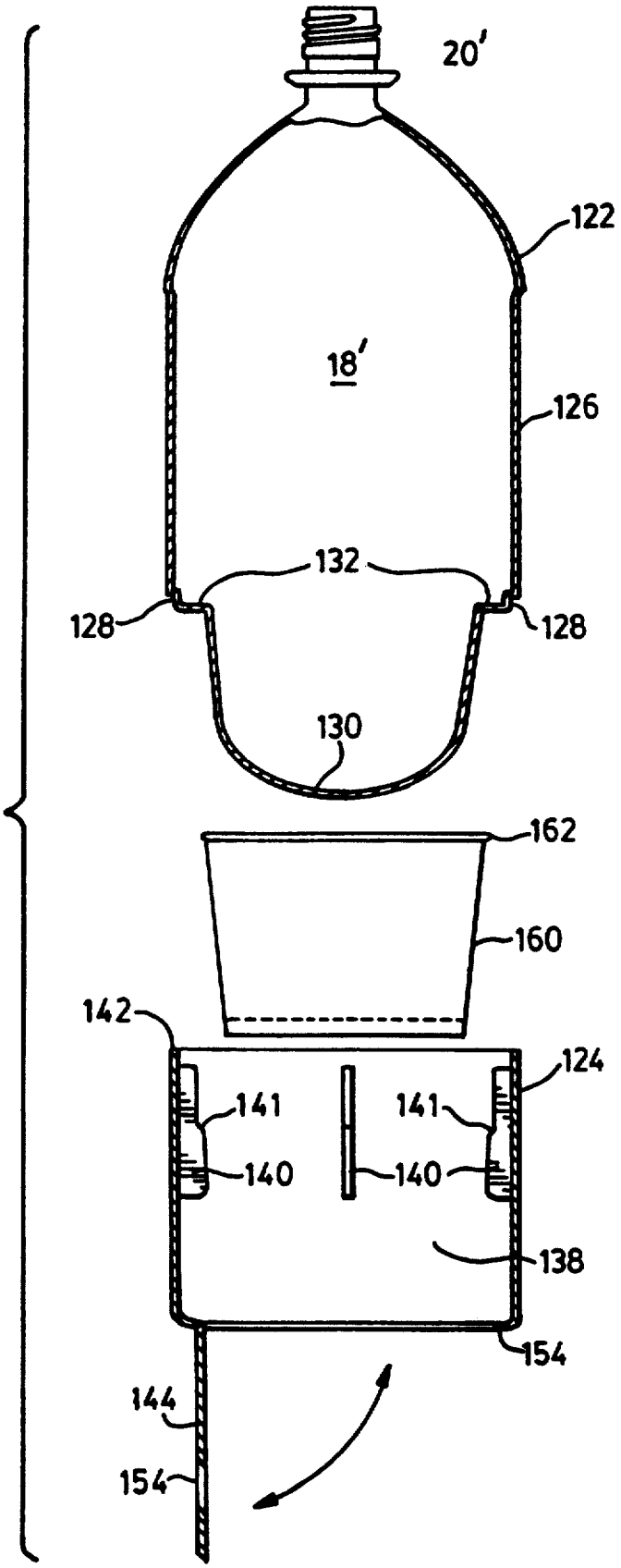
FIG. 11 is an exploded view of the liquid dispenser of FIG. 10.

Referring to FIGS. 10 and 11, another embodiment of a liquid dispenser with a cup holder is shown generally at 120. Dispenser 120 comprises a container having two parts, a liquid storage container 122 and a base 124. Liquid storage container 122 includes a cylindrical portion 126 having a lower indented peripheral edge 128 and a rounded bottom portion 130 connected to a shoulder 132 along the inner edge 134 of the shoulder. The outer edge 136 of shoulder 132 is connected to the bottom indented peripheral edge 128 of cylindrical portion 126. Container 122 may be fabricated from a suitable plastic which is heated and blow molded to give the shape shown in these Figures. Details of the molding process used to produce container portion 122 will be well known to those skilled in the art.

Figure 12:
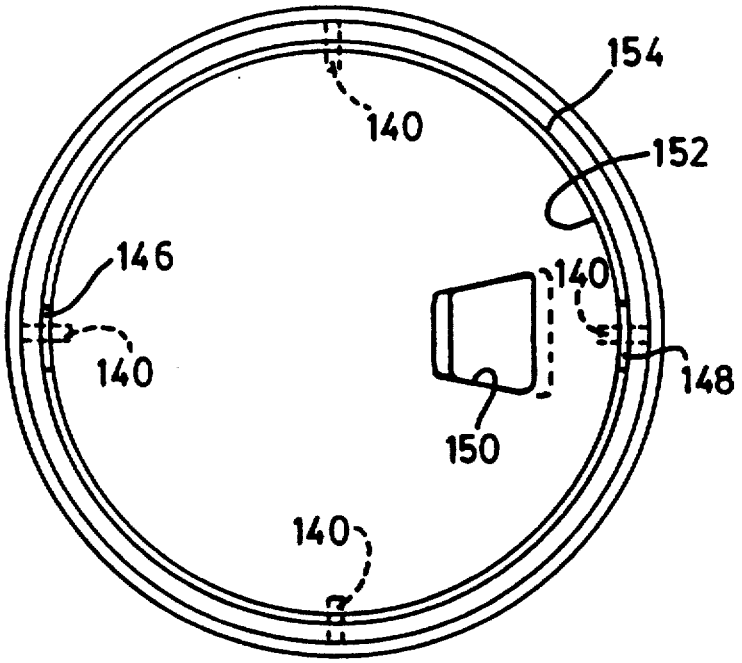
FIG. 12 is a view looking along arrow A of FIG. 10.

Base 124 is cylindrically shaped and defines a hollow recess 138 having four protrusions 140 extending in hollow recess 138 located at 90 degrees with respect to each other about the inner surface of the base and spaced below upper edge 142 of the base. Base 124 may be fabricated by standard injection molding processes as will be known to those skilled in the art. Protrusions 140 are shaped and sized to provide a shoulder 141 which supports cups located within recess. Referring to FIGS. 11 and 12, base 124 may be provided with a closure member or door 144 integrally attached to the rest of the base at 146 and 148. The integral attachment of door 144 to base 124 at 148 is of a frangible nature and door 144 is provided with an aperture 150 in close proximity to frangible connection 148 so that a user may open the door by inserting their finger into aperture 150 and pulling downwards thereby breaking the connection at 148. Door 144 may then be hingedly moved about connection 146. The peripheral edge 152 of door 144 and the adjacent edge 154 of base 124 may be angled as shown so that when the door is closed the edge thereof snaps over the angle edge of the base and is retained in the closed position.

Liquid dispenser 120 may be assembled by filling hollow recess 138 of base 124 with the requisite number of telescoped cups 160 so that the lip 162 of the lowest cup rests on shoulder 141 and then assembling base 124 with container portion 122 so that peripheral edge 142 is received into indented peripheral edge 128 of container 122. A permanent connection is formed between edge 142 and edge 128 by ultrasonic welding or other known bonding technique thereby securing container 122 and base 124 together. It will be appreciated that in addition or alternatively to storing cups in recess 138, other materials of a novelty or promotional nature may be stored within the recess. For example, compact discs, small toys, money and the like may be stored within recess 138. Assembling the cups with the base and container portion with frangible connection 148 still intact provides a tamper proof safety feature. Alternatively, door 144 may be dimensioned such that cups may be readily inserted and removed during use so that used cups may be stored within the storage area for purposes of recycling and the like.

While the liquid dispenser provided with the recessed cup holder has been described and illustrated with respect to the various embodiments disclosed herein, it will be appreciated that numerous variations of these embodiments may be made without departing from the scope of the invention disclosed herein.

I claim:

1. A liquid dispenser, comprising;

a) a container enclosing a liquid storage compartment and having an outlet passageway in flow communication with said liquid storage compartment through which liquid may be dispensed from said liquid storage compartment;

b) a separate base having sides and a base bottom defining a hollow portion, said base being attached to a bottom portion of said container, the bottom portion having a tapered protrusion extending into the hollow portion, and together with the sides of the separate base, defining a tapered recess for storing therein at least one cup, the base bottom having an opening for receiving said at least one cup into the tapered recess; and c) retaining means on said base for retaining said at least one cup in said tapered recess.

2. A liquid dispenser according to claim 1 including closure means for said outlet passageway for sealing closed said outlet passageway.

3. A liquid dispenser according to claim 2 wherein said container is generally cylindrically shaped having opposed first and second end portions and a longitudinal cylindrical axis, wherein said tapered recess extends from said second end portion towards said first end portion.

4. A liquid dispenser according to claim 3 wherein said tapered recess is an annular tapered recess symmetrically disposed about said longitudinal cylindrical axis.

5. A liquid dispenser according to claim 4 wherein said hollow portion is dimensioned to receive therein said at least one cup so that said cup does not extend outwardly beyond said base bottom.

6. A liquid dispenser according to claim 5 wherein said generally cylindrically shaped container is adapted to stand on said separate base, wherein the outlet passageway is located at the first end portion of the container and symmetrically disposed with respect to said longitudinal cylindrical axis.

7. A liquid dispenser according to claim 6 wherein said cup retaining means comprises a plurality of projections extending into said annular recess toward said longitudinal axis, said projections being integrally formed with said separate base.

8. A liquid dispenser according to claim 7 wherein said container portion is fabricated of plastic.

9. A liquid dispenser according to claim 7 wherein said tapered recess is tapered from a wide end adjacent said second end portion to a narrow end spaced from said first end portion.

10. A liquid dispenser, comprising;

a) a container portion enclosing a liquid storage compartment and having an outlet passageway at a top end thereof in flow communication with said liquid storage compartment through which liquid may be dispensed from said liquid storage compartment;

b) a separate base having a hollow portion and a bottom opening for accessing the hollow portion, said base being attachable to a bottom of said container portion, wherein said hollow portion of the base and said bottom of the container portion define a storage area for storing therein objects; and c) retaining means on said base for retaining said objects in said storage area.

11. A liquid dispenser according to claim 10 wherein said objects comprise at least one cup, wherein said retaining means is a cup retaining means for retaining said at least one cup in said storage area.

12. A liquid dispenser according to claim 11 wherein said liquid dispenser is generally cylindrically shaped having a longitudinal cylindrical axis and adapted to stand on said separate base when the base is attached to the container portion, wherein the outlet passageway is symmetrically disposed with respect to said longitudinal cylindrical axis.

13. A liquid dispenser according to claim 12 wherein said cup retaining means comprises a plurality of projections extending into said storage area, said projections being integrally formed with said separate base and shaped and dimensioned to have a lip of said at least one cup resting on a portion of said projections.

14. A liquid dispenser according to claim 13 wherein said separate base comprises a closure member attached thereto for closing off said bottom opening.

* * * * *